United States Patent [19]

Kisler

[11] Patent Number: 4,826,703

[45] Date of Patent: May 2, 1989

[54] METHOD AND APPARATUS FOR ELECTRICALLY CONTROLLING COATING LAYER DIMENSIONS

[75] Inventor: Semyon Kisler, Needham, Mass.

[73] Assignee: Polaroid Corporation, Cambridge, Mass.

[21] Appl. No.: 56,397

[22] Filed: Jun. 1, 1987

[51] Int. Cl.[4] ..... B05D 5/00; B05D 1/06; B05B 5/04

[52] U.S. Cl. ..... 427/14.1; 118/624; 118/625; 118/626; 427/26; 427/30; 427/32

[58] Field of Search ..... 427/26, 32, 30, 14.1; 118/624, 625, 626

[56] References Cited

U.S. PATENT DOCUMENTS

| | | | |
|---|---|---|---|
| 2,685,536 | 8/1954 | Starkey et al. | 118/626 X |
| 2,780,565 | 2/1957 | Juvinall | 118/626 X |
| 3,402,697 | 9/1968 | Kock | 118/624 |
| 3,512,502 | 5/1970 | Drum | 118/624 |
| 4,457,256 | 7/1984 | Kisler et al. | 118/621 |

*Primary Examiner*—Evan Lawrence
*Attorney, Agent, or Firm*—John J. Kelleher

[57] ABSTRACT

A method and apparatus are provided for controlling the width and improving edge thickness uniformity of a layer of coating material electrostatically deposited on a moving web surface. The apparatus preferably includes a coating applicator, a rotatably mounted web-supporting backing roll spaced therefrom and a source of electrical power coupled between applicator and backing roll for generating a coating material charging and transporting electrostatic field capable of transporting the charged coating material from the applicator to a web surface as the web moves between applicator and backing roll for web coating purposes. The apparatus additionally includes a pair of electrodes coupled to a source of electrical power and mounted in an opposed relation on opposite sides of the charged coating material moving between the coating applicator and the web surface spaced therefrom. Electrode potential is adjusted to a level that will interact with the charged coating material passing therebetween and thereby cause a layer of coating material of predetermined width and improved edge thickness uniformity to be deposited on a selected portion of a moving web surface.

9 Claims, 2 Drawing Sheets

FIG 3A
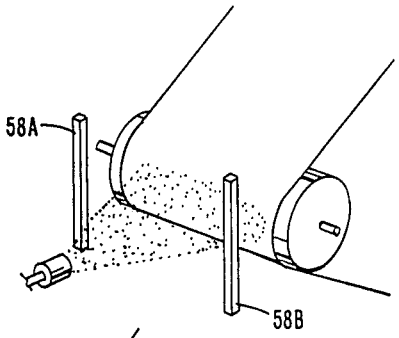
FIG 3B
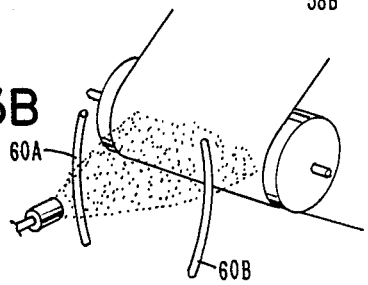
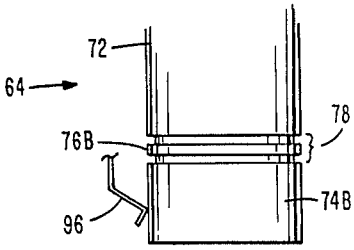
FIG 4B
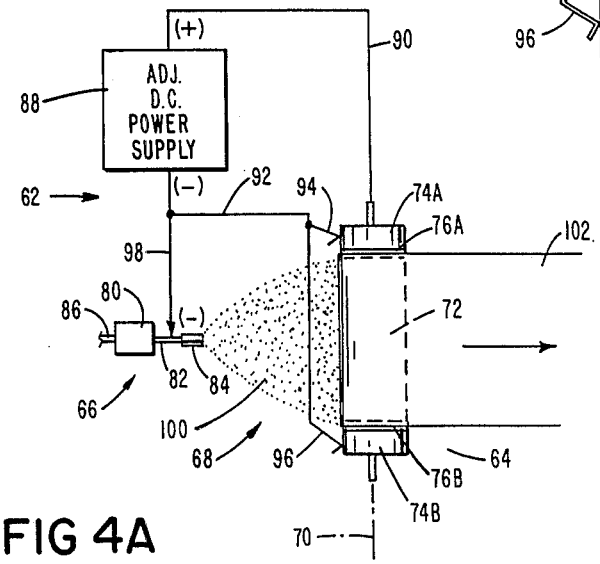
FIG 4A

METHOD AND APPARATUS FOR ELECTRICALLY CONTROLLING COATING LAYER DIMENSIONS

BACKGROUND OF THE INVENTION

The present invention relates to a coating method and apparatus employing an electrostatic field, in general, and to such a method and apparatus for electrostatically depositing a layer of coating material on the surface of a moving web, in particular.

Apparatus employing an electrostatic field for depositing coating materials on the surface of a moving web are well known in the prior art. In one arrangement described in U.S. Pat. No. 2,685,536 to Starkey et al, for example, a method of electrostatically depositing coating material on the surface of an object is disclosed. In said Starkey et al patent, an electrostatic field is established between a coating applicator coupled to a source of coating material and an object surface spaced therefrom. In this particular coating arrangement the electrostatic field both atomizes coating material oozing from applicator orifices and subsequently deposits same on said object surface. A more typical use of an electrostatic field in a coating application is that described in U.S. Pat. No. 4,457,256 to Kisler et al. In said Kisler et al patent an electrostatic field is employed to assist in depositing coating material on the surface of a moving web spaced therefrom after the coating material is extruded through an applicator opening. The electrostatic field assists in transporting the coating material between the applicator and web surface and, in addition, increases surface tension to thereby enable larger and therefore less critical spacing dimensions to be employed between applicator opening and the web surface during the web coating process.

In some coating arrangements, the width of a layer of coating material that can be deposited on the surface of a moving web or other substrate by a particular coating applicator may be substantially larger or smaller than a coating layer width that is optimum for some particular web coating application. In addition, in certain circumstances, it may be advantageous to provide a border or an uncoated web surface portion between the edge of a layer of coating material deposited on a web surface and the edge of the web on which the layer of coating material is deposited. As a consequence, it necessarily follows that coating width size may have to be changed (increased or decreased) if the optimum or desired coating layer width is to be achieved for the particular web coating application. Heretofore, the width of a coating layer was normally changed by changing the coating applicator configuration. In, for example, an extrusion type coating applicator, this would entail a change in the width of the opening through which coating material is extruded. However, substituting one extrusion-type coating applicator for another in order to form a particular coating layer width is relatively costly both in terms of the additional applicator or applicators that must be stockpiled in order to make such substitutions possible and the time required to physically substitute one applicator for another.

In addition to these coating layer width considerations, electrostatically depositing coating material on a web surface with coating apparatus such as those mentioned above produces a web coating layer with a varying (tapering) edge thickness. In applications where constant coating layer thickness is essential for proper functioning of the coated web in a particular operational environment, the varying thickness edge portions of the coated web would be unuseable. This varying thickness edge problem is often compensated for by coating the web or other substrate with a layer of coating material that is substantially wider than necessary or wide enough to position these edge portions in a location where they will have no effect on the application where the particular coating layer is to be employed. Disadvantages associated with this particular solution are the necessary reduction in border width between the coating layer and the edge of the coated web, which reduces the amount of border area that is available for other purposes, and the increased costs associated with the additional coating materials needed to so increase coating layer width.

It is a primary object of the present invention, therefore, to provide a coating method and apparatus that are capable of readily changing the width of a layer of coating material to be deposited on a substrate.

It is another object of the present invention to provide a coating method and apparatus that are capable of readily forming a border of any width within a range of border widths between the edge of a layer of coating material deposited on a substrate and the edge of the substrate on which the coating material is deposited.

It is a further object of the present invention to provide a coating method and apparatus that are capable of applying a layer of coating material to a substrate having edge portions that are of uniform thickness.

Other objects, features and/or advantages of the present invention will be apparent from the following detailed description of a preferred embodiment thereof taken in conjunction with the accompanying drawings.

SUMMARY OF THE INVENTION

In accordance with the present invention, a coating method and apparatus are provided for controlling the placement and thickness of an edge of a coating material layer electrostatically deposited on a substrate. The apparatus includes a coating applicator, means for supporting said substrate in a spaced relation from said applicator and means for generating a coating material charging and transporting electrostatic field capable of transporting the charged coating material from applicator to substrate as said substrate moves between applicator and substrate support means for substrate coating purposes. The apparatus additionally includes at least one electrode, coupled to a source of electrical power, positioned adjacent said charged coating material. Electrode potential is adjusted to a level that will interact with the said charged coating material adjacent thereto to thereby improve coating layer edge thickness uniformity and cause an edge portion of said coating layer to be deposited along a selected path on said moving substrate.

BRIEF DESCRIPTION OF THE DRAWINGS

FIGS. 3A and 3B are alternate embodiments of the coating material focusing electrodes shown in drawing FIG. 1.

FIG. 4A is a schematic diagram of web coating apparatus employing a segmented backing roll as the coating material focusing electrodes.

FIG. 4B is an enlarged detail of one end of the segmented backing roll shown in drawing FIG. 4A.

DESCRIPTION OF THE PREFERRED EMBODIMENT(S)

Figure 1:
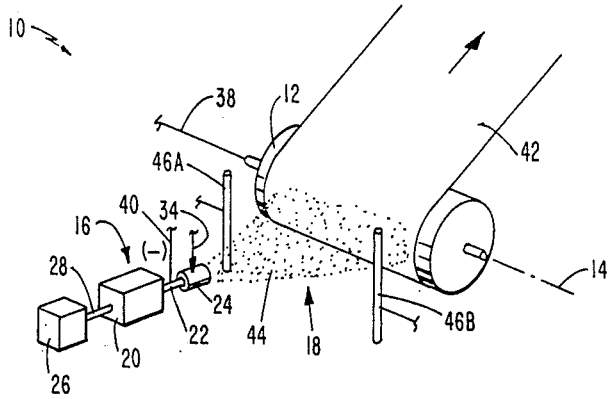
FIG. 1 is a perspective view of a web coating arrangement employing a preferred embodiment of the coating material dimension controlling apparatus of the present invention.

Turning now to the drawings, there is shown in FIG. 1 a perspective view of web coating apparatus 10 employing the coating layer dimension controlling apparatus of the present invention. Coating apparatus 10 in said FIG. 1 includes cylindrically shaped and electrically conductive backing roll 12 that is mounted for rotation about backing roll axis 14. Apparatus 10 also includes extrusion-type coating applicator 16 mounted in a fixed position with respect to said backing roll axis 14 and spaced from the cylindrical surface of backing roll 12 by the gap 18.

Coating applicator 16 comprises pressurizable coating material vessel 20 having electrically conductive nozzle 22 projecting through a wall thereof and having dielectric tube or sleeve 24 slidably mounted on its external surface with the free end of said tube extending beyond the end of said nozzle 22. The term "dielectric" as employed herein means a material having a resistivity equal to or greater than $10^9$ ohms per square. Nozzle 22 is formed of stainless steel, is of circular cross-section and has a coating material conducting circular opening through the center thereof that is 0.075 inch in diameter. Dielectric tube 24 is of circular cross-section and is formed of polytetrafluorethylene having a tube wall thickness of 0.10 inch with its circular opening having a diameter of 0.030 inch. The free end of dielectric tube 24 preferably extends approximately 0.25 inch beyond the end of conductive nozzle 22. The free end of dielectric tube 24 is preferably truncated or cut at 90° with respect to the principal direction of coating material flow through said tube 24.

Pump 26 coupled to vessel 20 through tube 28 pressurizes coating material within said vessel 20 to a pressure level that will produce the desired coating material flow rate through applicator nozzle 22 and dielectric tube 24. Pump 26 includes a conventional pump pressure regulator (not shown) to mechanically limit, to the extent possible, fluctuations in the output pressure of said pump 26 and coating material within applicator 16 coupled thereto. Pressure generated by pump 26 is ideally adjusted to a level that will maintain a substantially constant or unvarying volume of coating material at the output end of dielectric tube 24 or at that end of tube 24 extending beyond the output end of electrically conductive nozzle 22 as best shown in drawing FIG. 2.

Figure 2A:
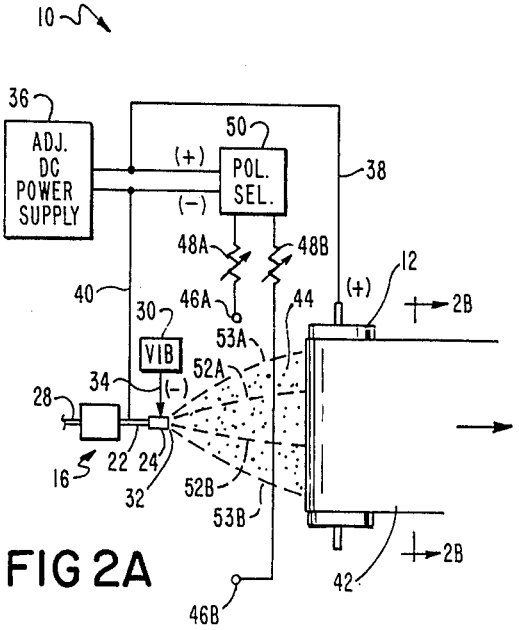
FIG. 2A is a schematic diagram of the web coating apparatus of FIG. 1 showing the electrostatic field generating portion thereof in much greater detail.

With reference to both FIGS. 1 and 2A of the drawings, mechanical vibrator 30 is provided whose primary function is to insure that a uniform flow of coating material from vessel 20 within coating applicator 10 is supplied to outer edge 32 of dielectric tube 24 or the edge formed by the tubular outer surface and the truncated end of said tube 24. Mechanical vibrator 30 is employed in the same manner as the corresponding vibrator described in abandoned U.S. patent application Ser. No. 032,606, filed April 1, 1987, by Kisler et al., in common assignment herewith. Mechanical vibrator 30 is of conventional design and is preferably of the type whose vibration amplitude can be adjusted and whose vibration frequency can be varied over a range of from 5 to 10,000 Hz with its vibration member being coupled to dielectric tube 24 through path 34. Vibrator 30 is electrically powered with its operating power being derived from a dc power supply (not shown) electrically connected to said vibrator 30. Forces applied to delectric tube 24 by vibrator 30 must be applied in a direction that is transverse of the principal direction of coating material flow through said tube 24 and preferably at a right angle thereto in order to produce constant thickness web surface coatings. Forces in the direction of such coating material flow of a magnitude sufficient to alter the flow rate of coating material to edge 32 of dielectric tube 24 would cause variations in the radius of curvature of the coating material at edge 32 of dielectric tube 24. Vibrator 30 not only insures a constant rate of coating material flow to edge 32 of tube 24, it also insures that the radius of curvature of coating material at said edge 32 remains substantially constant during the coating process.

Coating material at edge 32 of tube 24 can be thought of as the end of an electrode having a particular radius of curvature. As is well known, changes in this radius of curvature can produce changes in the intensity of an electrostatic field emanating therefrom for any selected electrostatic field generating voltage. If the electrode voltage is held constant, an increase in the radius of curvature at the end of the electrode will produce a decrease in local electrostatic field intensity, whereas a decrease in the radius of curvature at the end of the same electrode will produce a corresponding increase in the local electrostatic field intenstiy. Consequently, variations in this radius of curvature would produce variation in local electrostatic field intensity and therefore variations in the thickness of a layer of coating material deposited by said electrostatic field. Applying a component part of a transverse vibrator 30 force in the principal direction of coating material flow through tube 24 would be acceptable so long as the force level does not adversely affect the flow of coating material to edge 32 of said tube 24.

High voltage dc power supply 36, having a voltage across its output terminals in the range of several thousand volts, has its positive and negative output terminals connected between backing roll 12 and electrically conductive nozzle 22 through paths 38 and 40, respectively. Voltage from power supply 36 is coupled to coating material within applicator 16 through said electrically conductive nozzle 22. If nozzle 22 was not electrically conductive, voltage from power supply 36 could be coupled to said coating material by means of an electrode (not shown) projecting through applicator 16 and into contact with same. When power supply 36 is so connected between backing roll 12 and applicator nozzle 22, an electrostatic field is established in gap 18 between coating material at edge 32 of dielectric tube 24 and the cylindrical outer surface of conductive backing roll 12. When web 42 is passed over said cylindrical surface of web-supporting backing roll 12 through gap 18, an electrostatic field is also established between coating material at said edge 32 of tube 24 and the surface of web 42 immediately adjacent gap 18.

With continued reference to FIGS. 1 and 2A of the drawings, when an electrostatic field of predetermined intensity is established between coating material at edge 32 of dielectric tube 24 and the adjacent surface of moving web 42, the coating becomes charged and then minute particles 44 are atomized or extracted from coating material at said edge 32 by forces associated with said electrostatic field. These minute coating material particles 44 formed by the electrostatic field are subsequently transported to and deposited on the adjacent surface of moving web 42, by the same electrostatic field, in an extremely thin layer.

As shown in FIG. 2A, coating apparatus 10 also includes a pair of focusing electrodes 46A and 46B coupled to dc power supply 36 through variable resistors 48A and 48B, respectively, and through electrical polarity selector 50. Focusing electrodes 46A and 46B are a pair of linear, electrically conductive rods, of circular cross-section, mounted in an opposed relation on opposite sides of atomized coating material 44 moving between coating applicator 16 and the adjacent surface of moving web 42. The magnitude and polarity of the voltage to be applied to focusing electrodes 46A and 46B is determined by polarity selector 50 and variable resistors 48A and 48B. Polarity selector 50 can establish either a positive or a negative voltage on the electrodes and variable resistors 48A and 48B can respectively establish any voltage level on focusing electrodes 46A and 46B up to the maximum output voltage level of dc power supply 36.

The width of a layer of coating material deposited on the surface of moving web 42 by coating applicator 16 in coating apparatus 10 is primarily determined by the magnitude and polarity of the voltages applied to focusing electrodes 46A and 46B. As previously explained, in coating apparatus 10 (FIG. 2A), the negative terminal of power supply 36 is electrically coupled to the coating material within coating applicator 16 and therefore coating material particles 44 atomized by the electrostatic field established between coating applicator 16 and the adjacent surface of web 42 have a negative charge placed on these coating material particles by said negative power supply terminal. These negatively charged particles 44 are subsequently attracted to the adjacent surface of moving web 42 by the attractive force of the positive voltage on web supporting backing roll 12 supplied by dc power supply 36. These negatively charged particles spread outwardly from the free end of dielectric tube 24 as they move toward said adjacent web 42 surface. In a typical web coating application employing coating apparatus 10, absent focusing electrodes 46A and 46B, coating material particles 44 would be concentrated at the center portion of web 42 or within the envelope defined by dashed lines 52A and 52B. However, when electrically charged focusing electrodes 46A and 46B are employed, coating material 44 may be uniformly spread all the way out to the edges of web 42 from tube 24 or to any extent intermediate thereof.

The polarity of the voltage applied to focusing electrodes 46A and 46B by polarity selector 50 is positive or the same polarity that is applied to conductive backing roll 12 by dc power supply 36. The magnitude of the voltage applied to focusing electrodes 46A and 46B is established by the manual adjustment of variable resistors 48A and 48B, respectively, and is determined by the extent to which coating material 44 flowing from tube 24 must spread out toward the edges of moving web 42. When the proper voltage levels have been established on focusing electrodes 46A and 46B, portions of negatively charged coating material 44 are attracted toward positively charged electrodes 46A and 46B and toward positively charged backing roll 12 movably supporting web 42. As those portions of negatively charged coating material 44 approach the vicinity of focusing electrodes 46A and 46B under the influence of the positive voltages present thereon, their direction of movement is changed by the stronger attractive force provided by the more positive voltage present on backing roll 12. As a consequence, the desired width of atomized coating material 44 is deposited, in a uniform thickness layer, on that surface of moving web 42 adjacent coating applicator tube 24.

It should be noted that in some web coating applications it may be necessary to concentrate or reduce the width of a layer of coating material to be deposited on a web surface by a coating applicator. Focusing electrodes 46A and 46B in coating applicator 10 can readily produce a reduction in coating layer width. In such applications, the polarity of the voltages applied to said focusing electrodes 46A and 46B would be the opposite of that on backing roll 12. If, for example, a layer of negatively charged coating material 44 in FIG. 2A were to be deposited on a surface of web 42 in a concentrated or reduced width form, the polarity of the voltages applied to focusing electrodes 46A and 46B must be negative. These negative voltages on focusing electrodes 46A and 46B positioned on opposite sides of the negatively charged coating material 44 flowing between applicator 16 and web 42 will repel said material 44 toward the center portion of said web 42 to thereby concentrate or reduce the width of a layer of coating material deposited on said web 42. The magnitude of the voltages applied to electrodes 46A and 46B is determined by the extent to which coating layer width must be reduced.

Figure 2B:
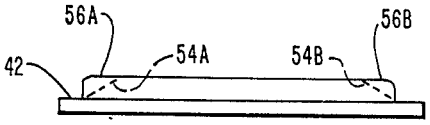
FIG. 2B is a sectional view taken on the line 2B—2B in drawing FIG. 2A.

An additional advantage resulting from the use of focusing electrodes 46A and 46B in coating apparatus 10 to control the width of a layer of coating material deposited on a surface of a moving web is the improvement in coating thickness uniformity at the coating layer edge portions. As shown in FIG. 2B, which is a cross-sectional view taken on the line 2B—2B in FIG. 2A, absent the use of focusing electrodes 46A and 46B in coating apparatus 10, the lateral edge portions of the layer of coating material deposited on web 42 by coating applicator 16 would slope or be of nonuniform thickness such as shown by dashed lines 54A and 54B. However, when focusing electrodes 46A and 46B are employed, coating thickness uniformity remains constant throughout substantially the entire coating layer width including edge portions 56A and 56B of drawing FIG. 2B.

Focusing electrodes 46A and 46B have been described herein as a pair of linear, electrically conductive rods of circular cross-section. However, other electrode shapes, sizes, etc., may be employed in this or other web coating applications if such electrodes can modify the coating material flow pattern between coating application and adjacent web surface and thereby produce the desired coating layer dimensions. For example, in FIG. 3A, a pair of linear rods 58A and 58B, of rectangular cross-section, are employed for coating layer dimension control whereas in FIG. 3B, a pair of curved rods 60A and 60B, of circular cross-section, are employed for such purposes.

An alternate, though less preferable, form of the web coating layer-dimension controlling concept of the present invention is shown in drawing FIG. 4A. FIG. 4A is a schematic diagram of web coating apparatus 62 employing segmented backing roll 64 as the coating layer dimension controlling electrodes of the present invention. Segmented backing roll 64 in said coating apparatus 62 is spaced from coating applicator 66 by the gap 68 and is mounted for rotation about axis 70. Each segment of segmented backing roll 64 is electrically conductive and comprises cylindrical center segment 72 and cylindrical outer segments 74A and 74B at opposite ends thereof that are electrically isolated from said segment 72 by insulators 76A and 76B, respectively.

An enlarged view of the details of insulator 76B, which electrically insulates center segment 72 from end segment 74B of backing roll 64, is shown in drawing FIG. 4B. As shown in FIG. 4B, external surface 78 of insulator 76B between segments 72 and 74B has been made irregular in order to increase insulator 78B external surface area and therefore the voltage level that said insulator 76B can withstand before electrical breakdown. Insulator 76A between segments 72 and 72A has the same external surface configuration as insulator 76B for the same electrical breakdown considerations.

Coating apparatus 62 also includes extrusion-type coating applicator 66 comprising pressurizable vessel 80 having electrically conductive nozzle 82 projecting through a wall thereof and having dielectric tube 84 slidably mounted on its external surface. Vessel 80 is coupled to a source of pressurized coating material through tube 86 in the same manner and to the same extent as the corresponding components in coating apparatus 10 shown in drawing FIGS. 1 and 2A. High voltage dc power supply 88, having a voltage across its output terminals in the range of several thousand volts, has its positive output terminal connected to center segment 72 of backing roll 64 through path 90 and its negative output terminal connected to outer segments 74A and 74B through path 92 and siding contacts 94 and 96, respectively, and to electrically conductive nozzle 82 through path 98. When power supply 88 is so connected between backing roll 64 and applicator nozzle 82 an electrostatic field is established in gap 68 between coating material at the output of the tube 84 and the cylindrical outer surface of center segment 72 of said backing roll 64. When such an electrostatic field is so established, the coating becomes negatively charged by the negative terminal of power supply 88 that is electrically coupled thereto. Minute particles 100 are then atomized or extracted from coating material at the output of tube 84 by forces associated with said electrostatic field. These minute particles are subsequently transported to and deposited on the adjacent surface of moving web 102, by the same electrostatic field, in an extremely thin layer. The width of the coating layer deposited on web 42 is determined by the length of center segment 72 of web supporting backing roll 64. The negative voltage on outer backing roll segments 74A and 74B supplied by dc power supply 88 redirects (repels) any negatively charge that might extend beyond the ends of center backing roll segment 72 toward said segment 72 and, in addition, improves coating edge thickness uniformity. The width of a layer of coating material deposited on moving web 102 by coating apparatus 62 may be varied by varying the length of center segment 72 of web supporting backing roll 64. However, controlling web coating layer width by changing the length of center segment 72 is significantly more difficult and costly than it is with the coating layer width controlling apparatus described above with respect to drawing FIGS. 1 and 2A.

It will be apparent to those skilled in the art from the foregoing description of our invention that various improvements and modifications can be made in it without departing from its true scope. The embodiments described herein are merely illustrative and therefore should not be viewed as the only embodiments that might encompass our invention.

What is claimed is:

1. Apparatus for controlling the deposition of coating material on a moving substrate, comprising:

a coating applicator mounted in a fixed position and adapted for coupling to a source of coating material;

means for movably supporting a substrate in a spaced relation from said coating applicator to thereby form a coating gap between said applicator and said substrate, said support means including a rotatably mounted, electrically conductive backing roll having a center portion and a pair of end portions that are electrically isolated from one another wherein said backing roll end portions form an electrode pair and the width of said center portion determines the width of a layer of coating material to be deposited on the substrate movably supported by said backing roll;

means for establishing an electrostatic field in said coating gap for charging coating material flowing from said coating applicator and for subsequently transporting said charged coating material to the substrate;

means for establishing an electrical potential of predetermined magnitude and polarity on each of the electrodes forming said electrode pair; and means for moving said substrate through said coating gap whereby the electrical potential on said electrodes interacts with said charged coating material to thereby control the deposition of coating material on the moving substrate.

2. Apparatus for controlling the deposition of coating material on a moving substrate, comprising:

a coating applicator mounted in a fixed position and adapted for coupling to a source of coating material;

means for movably supporting a substrate in a spaced relation from said coating applicator to thereby form a coating gap between said applicator and said substrate;

means for establishing an electrostatic field in said coating gap for charging coating material flowing from said coating applicator and for subsequently transporting said charged coating material to the substrate;

an electrode assembly including a pair of electrodes mounted in an opposed relation adjacent said coating gap and means for establishing an electrical potential of predetermined magnitude and polarity on each of the electrodes forming said electrode pair, said electrode potential establishing means including means for establishing an electrical potential on each electrode of said electrode pair whose magnitude and/or polarity can be varied independently of one another; and means for moving the substrate through said coating gap whereby the electric potential on said pair of electrodes interacts with the charged coating material to thereby control the deposition of coating material on the moving substrate.

3. The invention of claim 2, wherein each of said electrodes is formed of a linear rod of circular cross section.

4. The invention of claim 2, wherein each of said electrodes is formed of a linear rod of rectangular cross section.

5. The invention of claim 2, wherein said coating applicator is of the extrusion type having an opening therein formed of dielectric material from which coating material flows for substrate coating purposes.

6. Apparatus for controlling the width and edge portion thickness of a layer of coating material electrostatically deposited on a moving substrate, comprising:

an extrusion-type coating applicator mounted in a fixed position and adapted for coupling to a source of coating material, said applicator having an opening therein formed of dielectric material from which coating material flows for substrate coating purposes;

means for pressurizing coating material within said coating applicator to a pressure level that will maintain a substantially constant volume of coating material at the output of said dielectric applicator opening;

means for movably supporting a substrate in a spaced relation from said applicator opening output to thereby form a coating gap between said output and said substrate;

means for applying a vibratory force to coating material at said applicator opening to thereby cause coating material to flow to a selected portion of the output of said applicator opening;

means for establishing an electrostatic field in said coating gap between coating material at said applicator opening output and a substrate spaced therefrom to charge said coating material and to extract minute coating material particles from coating material at said applicator opening output and subsequently deposit said extracted particles on said substrate;

an electrode assembly including a pair of electrodes mounted in an opposed relation on opposite sides of said coating gap and means for establishing an electrical potential, of predetermined magnitude and polarity, on each of the electrodes forming said electrode pair; and means for moving said substrate through said coating gap, at a constant rate, whereby a relatively thin, uniform thickness layer of coating material is deposited on said substrate and whereby the electric potential on each of said electrodes interacts with said charged coating material to thereby cause coating material layer edge portions, of constant thickness, to be deposited along selected paths and thereby produce a coating layer of controlled width on said moving substrate.

7. A method of controlling the width and edge portion thickness of a layer of coating material electrostatically deposited on a moving substrate, comprising the steps of:

providing a coating applicator, in a fixed position, adapted for coupling to a source of coating material;

movably supporting a substrate in a spaced relation from said coating applicator to thereby form a coating gap between said applicator and said substrate;

establishing an electrostatic field in said coating gap for charging coating material flowing from said coating applicator and for subsequently transporting said charged coating material to said substrate;

providing an electrode assembly including an electrode mounted adjacent said coating gap and means for establishing an electrical potential, of predetermined magnitude and polarity, on said electrode; and moving said substrate through said coating gap whereby the electric potential on said electrode interacts with said charged coating material to thereby cause a coating material layer edge portion, of constant thickness, to be deposited along a selected path and thereby produce a coating layer of controlled width on said moving substrate.

8. The method of controlling the width and edge portion thickness of a layer of coating material electrostatically deposited on a moving substrate in accordance with claim 7, wherein said electrode assembly includes a pair of electrodes mounted in an opposed relation adjacent said coating gap and said step of providing means for establishing an electrical potenial on said electrode of predetermined magnitude and polarity includes providing an electrical potential of predetermined magniude and polarity on each electrode forming said electrode pair.

9. The method of controlling the width and edge portion thickness of a layer of coating material electrostatically deposited on a moving substrate in accordance with claim 8, wherein said step of providing an electrical potential of predetermined magnitude and polarity on each electrode forming said electrode pair includes providing an electrical potential on each electrode of said electrode pair whose magnitude and/or polarity can be varied independently of one another.

* * * * *